US006213102B1

(12) United States Patent
Isobe et al.

(10) Patent No.: US 6,213,102 B1
(45) Date of Patent: Apr. 10, 2001

(54) EVAPORATED FUEL TREATMENT DEVICE

(75) Inventors: Takashi Isobe; Takashi Yamaguchi, both of Saitama; Satoshi Kiso, Tochigi, all of (JP)

(73) Assignee: Honda Giken Kogyo Kabushikikaisha, Tokyo (JP)

( * ) Notice: Subject to any disclaimer, the term of this patent is extended or adjusted under 35 U.S.C. 154(b) by 0 days.

(21) Appl. No.: 09/496,124

(22) Filed: Feb. 1, 2000

(30) Foreign Application Priority Data

Feb. 5, 1999 (JP) ..... 11-029262
Nov. 2, 1999 (JP) ..... 11-312237

(51) Int. Cl.[7] ..... F02M 37/04
(52) U.S. Cl. ..... 123/520
(58) Field of Search ..... 123/516, 518, 123/520, 494

(56) References Cited

U.S. PATENT DOCUMENTS 5,732,687 * 3/1998 Hashimoto et al. ..... 123/520
5,746,191 * 5/1998 Isobe et al. ..... 123/520
5,765,539 * 6/1998 Isobe et al. ..... 123/520
5,775,307 * 7/1998 Isobe et al. ..... 123/520
5,799,639 * 9/1998 Isobe et al. ..... 123/520
5,826,566 * 10/1998 Isobe et al. ..... 123/520
5,845,625 * 12/1998 Kidokoro et al. ..... 123/520
5,954,034 * 9/1999 Takagi ..... 123/520

FOREIGN PATENT DOCUMENTS 7-012016 1/1995 (JP) .
9-317572 12/1997 (JP) .

* cited by examiner

*Primary Examiner*—Thomas N. Moulis
(74) *Attorney, Agent, or Firm*—E. Russell Tarleton; Seed IP Law Group PLLC

(57) ABSTRACT

In an evaporated fuel treatment device for an internal combustion engine which has a fuel tank, a canister having an interior and an opening that opens the interior to the atmosphere, and which adsorbs evaporated fuel generated inside the fuel tank, a charging passage that communicates with the fuel tank and with the canister, a pressure adjustment valve provided in the charging passage, an internal pressure sensor provided upstream from the pressure adjustment valve to detect and output the vapor pressure inside the fuel tank, and a fuel tank system leakage detector that detects leakage in the fuel tank system on the upstream side of the pressure adjustment valve according to the output of the sensor, the device having at least a first stored reference value for a first leak diameter constituting an object of detection and a second stored reference value for a second leak diameter constituting an object of detection, and the leakage detector configured to detect the presence or absence of leakage by comparing the output of the internal pressure sensor with the first and second reference values.

6 Claims, 8 Drawing Sheets

EVAPORATED FUEL TREATMENT DEVICE

FIELD OF THE INVENTION

The present invention concerns an evaporated fuel treatment device for an internal combustion engine in which evaporated fuel generated inside the fuel tank is released into the intake system of the engine. More specifically, the present invention concerns an evaporated fuel treatment device for an internal combustion engine which makes it possible to ascertain the presence or absence of leakage of evaporated fuel in an evaporated fuel discharge prevention system which covers from the fuel tank to the engine intake system.

BACKGROUND OF THE INVENTION

A method for ascertaining the presence or absence of leakage in the discharge prevention system of an evaporated fuel treatment device is described in Japanese Patent Application Kokai No. Hei 7-12016. In this method, when the detected internal pressure of evaporated vapor in the tank is a negative pressure of a predetermined value or greater relative to atmospheric pressure, this indicates that purging is being performed in a normal evaporated fuel treatment system during ordinary engine operation; accordingly, it is determined that there is no leakage of evaporated fuel from the evaporated fuel treatment system, and that the system is therefore operating normally. In cases where, for example, the internal pressure of the fuel tank remains stationary for a predetermined period of time in the vicinity of atmospheric pressure when such a "normal" determination is obtained in the above-mentioned process, a negative pressure diagnostic process is performed assuming that there is a possibility of leakage; in this case, the discharge prevention system is placed under a negative pressure, and the presence or absence of leakage in the tank system is ultimately determined from the negative pressure maintenance capability.

Furthermore, Japanese Patent Application Kokai No. Hei 9-317572 describes an evaporated fuel treatment device which is equipped with a bypass valve that bypasses the pressure adjustment valve in the charging passage connecting the fuel tank and the canister, and which separately ascertains the presence or absence of leakage in the tank system on the fuel tank side of the bypass valve and in the canister system on the canister side of the bypass valve. A determination of the presence or absence of leakage in the tank system is accomplished as follows: immediately after the engine is started, the bypass valve is opened so that the tank pressure is caused to move toward atmospheric pressure. If the shift in the tank pressure at this time is greater than a predetermined value, it is determined that the tank system is normal with no leakage. If there is leakage in the tank system, then the pressure in the fuel tank prior to starting is more or less equal to atmospheric pressure; accordingly, the shift in pressure is small.

As consideration for the environment has become more important, there has been a demand for stricter criteria in determining the presence or absence of leakage. However, the internal pressure in a fuel tank constantly changes due to various factors such as the temperature of the fuel, the degree to which surplus fuel is returned from the engine space, the load conditions of the vehicle, and vibration, etc. As a result, difficulties have been encountered in the accurate detection of the presence or absence of leakage caused by minute holes.

If there is frequent lighting of a warning lamp, etc., due to the erroneous detection of leakage in cases where there is actually no leakage, this results in a lowering of the practical utility of the vehicle. On the other hand, if no leakage is detected in cases where leakage is actually occurring, evaporated fuel continues to be released into the atmosphere.

Accordingly, there is a need for an evaporated fuel treatment device that can correctly detect the presence or absence of leakage caused by minute holes (e.g., holes with a diameter in the range of 0.5 mm).

SUMMARY OF THE INVENTION

An evaporated fuel treatment device in accordance with one aspect of the invention is intended for use in an internal combustion engine which has (a) a fuel tank, (b) a canister which has an opening that opens the interior of the canister to the atmosphere, and which adsorbs evaporated fuel generated inside the fuel tank, (c) a charging passage which causes the fuel tank to communicate with the canister, (d) a pressure adjustment valve which is provided in the charging passage, (e) an internal pressure sensor which is provided upstream from the pressure adjustment valve, and which is used to detect the pressure inside the fuel tank, and (f) a controller which detects leakage in the fuel tank system on the upstream side of the pressure adjustment valve according to the output of the sensor. The controller has at least a first reference value for a first leak diameter to be detected and a second reference value for a second leak diameter to be detected. The controller detects the absence of leakage by comparing the output of the internal pressure sensor with the first and second reference values.

In accordance with one aspect of the invention, the first and second reference values are set corresponding to a first leak diameter and second leak diameter respectively that constitute objects of detection, and the presence or absence of leakage is determined by means of the respective reference values. Accordingly, actions can be taken relative to the respective detections.

In accordance with another aspect of the invention, the evaporated fuel treatment device of the invention relates to an internal combustion engine which has (a) a fuel tank, (b) a canister which has an opening that opens the interior of the canister to the atmosphere, and which adsorbs evaporated fuel generated inside the fuel tank, (c) a charging passage which causes the fuel tank to communicate with the canister, (d) a pressure adjustment valve which is provided in the charging passage, (e) a bypass passage which bypasses the pressure adjustment valve in the charging passage, (f) a bypass valve which opens and closes the bypass passage, (g) an internal pressure sensor which is provided upstream from the pressure adjustment valve, and which is used to detect the pressure inside the fuel tank, and (h) a controller which detects leakage in the fuel tank system on the upstream side of the pressure adjustment valve according to the output of the sensor when the bypass valve is opened from a closed state. The controller of the second embodiment has at least a first reference value for a first leak diameter to be detected and a second reference value for a second leak diameter to be detected. The system detects the absence of leakage by comparing with the first and second reference values the difference between the output value of the internal pressure sensor when the bypass valve is closed and the output value of the internal pressure sensor when the bypass valve is opened to open the fuel tank system to the atmosphere.

In this embodiment, the presence or absence of leakage is determined by comparing with first and second reference values the difference between the output value of the internal pressure sensor that is obtained immediately after the starting of the internal combustion engine and the output value of the internal pressure sensor that is obtained when the fuel tank system is opened to the atmosphere. Accordingly, the question of whether or not the fuel tank system continues to have the function of maintaining pressure when the internal combustion engine is stopped, i.e., the question of whether or not any holes have been formed in the fuel tank system, can be determined with respect to two judgement criteria.

DETAILED DESCRIPTION OF THE INVENTION

Figure 1:
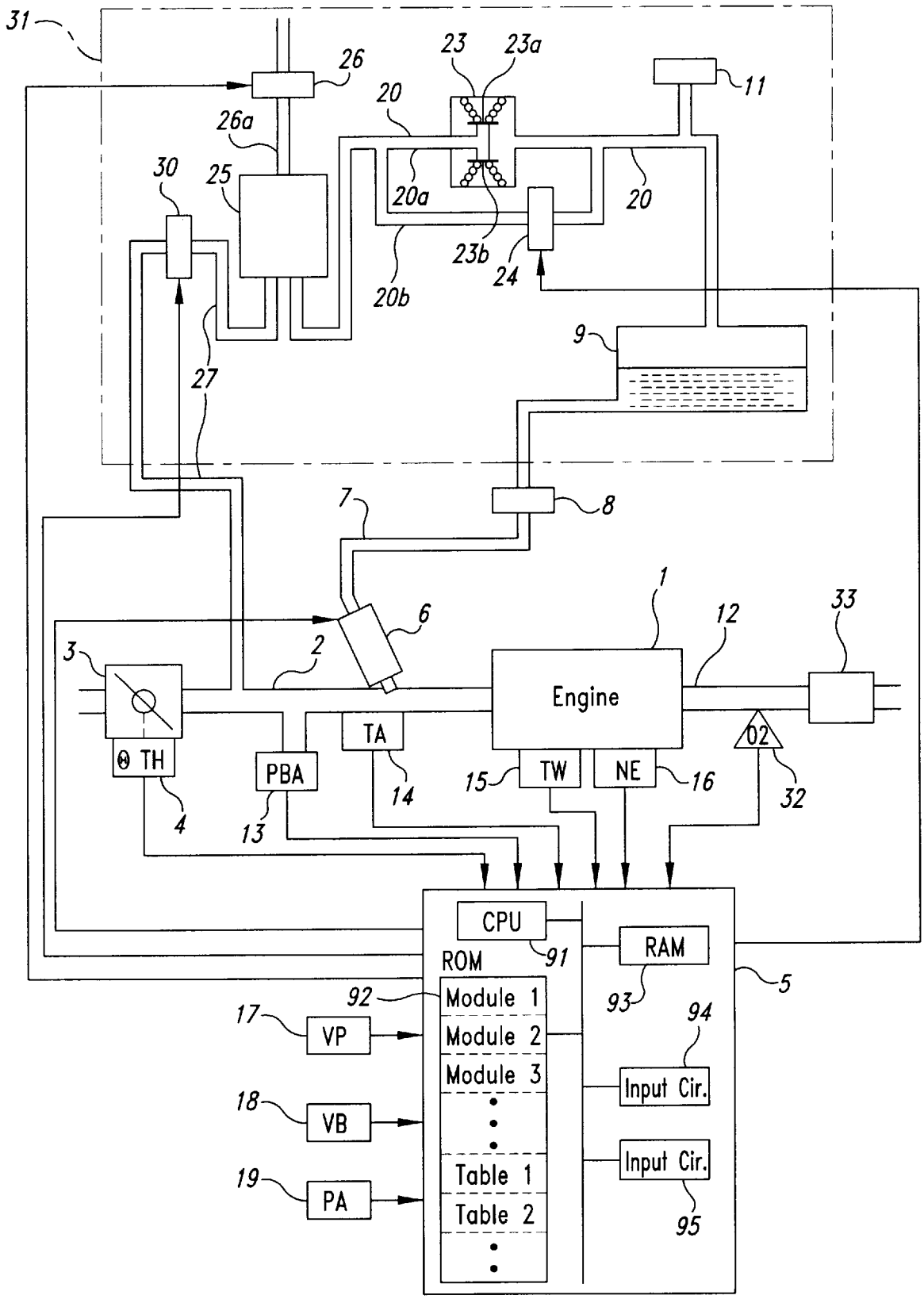
FIG. 1 is a diagram which shows the overall construction of the evaporated fuel treatment device in accordance with one embodiment of the present invention.

A working configuration in accordance with one embodiment of the present invention will be described with reference to the attached drawings. FIG. 1 is an overall structural diagram of an evaporated fuel treatment device for an internal combustion engine constructed according to one embodiment of the present invention. FIG. 1 shows an engine 1, an evaporated fuel discharge prevention device 31, and an electronic control unit (hereafter referred to as an "ECU") 5.

The ECU 5 constitutes the controller in the present invention, and is equipped with a CPU 91 which performs operations for the purpose of controlling various parts of the engine, a read-only memory (ROM) 92 which stores various types of data and programs for controlling various parts of the engine, a random-access memory (RAM) 93 which provides a working region for operations by the CPU 91, and which temporarily stores data sent from various parts of the engine and commands that are to be sent out to various parts of the engine, an input circuit 94 which receives data sent from various parts of the engine, and an output circuit 95 which sends out control signals to various parts of the engine.

In FIG. 1, programs are indicated as module 1, module 2, module 3, etc. In accordance with one embodiment of the present invention, the programs that detect the presence or absence of leakage are contained (for example) in modules 3, 4, 5 and 6. Furthermore, various types of data used in operations are accommodated in the ROM 92 in the form of table 1, table 2, etc. The ROM 92 may be a re-writable ROM such as an EEPROM; in such a case, the results of the operations performed by the ECU 5 in a given operating cycle can be stored in the ROM and utilized in the next operating cycle. Furthermore, large quantities of flag information set by various types of process can be recorded in this EEPROM and utilized in trouble diagnosis.

For example, the internal combustion engine 1 is an engine equipped with four cylinders, and an intake manifold 2 is connected to this engine. A throttle valve 3 is provided on the upstream side of the intake manifold 2, and a throttle valve open-degree sensor (θ TH) 4 which is connected to the throttle valve 3 outputs an electrical signal corresponding to the degree of opening of the throttle valve 3, which is sent to the ECU.

A fuel injection valve 6 is provided for each cylinder at an intermediate point in the intake manifold 2 between the engine 1 and the throttle valve 3, and the valve-opening timing is controlled by control signals from the ECU. A fuel supply line 7 connects each fuel injection valve 6 with the fuel tank 9, and a fuel pump 8 provided at an intermediate point supplies fuel to the injection valve 6 from the fuel tank 9. A regulator (not shown in the figures) is provided between the pump 8 and the injection valve 6; this regulator acts so that the differential pressure between the pressure of the air taken in from the intake manifold 2 and the pressure of the fuel supplied via the fuel supply line 7 is maintained at a constant value, thus causing surplus fuel to be returned to the fuel tank via a return line (not shown in the figures) in cases where the fuel pressure is too high. Furthermore, the air taken in via the throttle valve 3 passes through the intake manifold, and is supplied to the cylinders of the engine 1 after being mixed with fuel injected from the fuel injection valves 6.

An intake manifold pressure (PBA) sensor 13 and an intake air temperature (TA) sensor 14 are provided on the downstream side of the throttle valve 3 in the intake manifold 2. These sensors respectively detect the intake manifold pressure and intake air temperature, and convert these detection values into electrical signals which are sent to the ECU 5.

An engine water temperature (TW) sensor 15 is attached to the cylinder wall of the cylinder block of the engine 1; this sensor detects the temperature of the engine cooling water, and converts this detection value into an electrical signal which is sent to the ECU 5.

The engine 1 has an exhaust manifold 12; exhaust gas is discharged via a ternary catalyst 33 constituting an exhaust gas cleaning device which is provided at an intermediate point in the exhaust manifold 12. An O2 sensor 32 constitutes an exhaust gas concentration sensor; this sensor is provided at an intermediate point in the exhaust manifold; the sensor detects the oxygen concentration in the exhaust gas, and sends a signal corresponding to the detection value to the ECU 5.

A vehicle speed sensor 17, a battery voltage sensor 18 and an atmospheric pressure sensor 19 are connected to the ECU 5. These sensors respectively detect the operating speed of the vehicle, the battery voltage and the atmospheric pressure, and send the detection values to the ECU 5.

The input signals from the various sensors are transferred to the input circuit 94. The input circuit 94 shapes the input signal waveforms, corrects the voltage levels to correct levels, and converts the analog signal values into digital signal values. The CPU 91 processes the digital signals resulting from this conversion, performs operations in accordance with the programs stored in the ROM 92, and generates control signals that are sent to actuators in various parts of the vehicle. These control signals are sent to the output circuit 95, which in turn sends control signals to the fuel injection valves 6, bypass valve 24, vent shut valve 26, purge control valve 30 and other actuators.

Next, the evaporated fuel discharge prevention system 31 will be described. The discharge prevention system 31 is equipped with a fuel tank 9, a charging passage 20, a canister 25, a purging passage 27 and several control valves. This system controls the discharge of evaporated fuel from the fuel tank 9. For convenience, the discharge control system 31 may be divided into two parts, with the bypass valve 24 located in the charging passage 20 as the boundary. The side containing the fuel tank 9 will be referred to as the "tank system", while the side containing the canister 25 will be referred to as the "canister system".

The fuel tank 9 is connected to the canister 25 via the charging passage 20, so that evaporated fuel from the fuel tank 9 can move into the canister 25. The charging passage 20 has a first branch 20*a* and a second branch 20*b*; these are provided inside the engine compartment. An internal pressure sensor 11 is attached to the fuel tank side of the charging passage 20; this sensor detects the differential pressure between the pressure inside the charging passage 20 and the atmosphere. In a normal stage, the pressure inside the charging passage 20 is more or less equal to the pressure inside the fuel tank 9; accordingly, the pressure detected by the internal pressure sensor 11 may be viewed as the pressure of the fuel tank 9 (hereafter referred to as the "tank pressure").

A two-way valve 23 which adjusts the pressure inside the fuel tank is provided in the first branch 20*a*; this two-way valve 23 has two mechanical valves 23*a* and 23*b*. The valve 23*a* is a positive-pressure valve which opens when the tank pressure exceeds atmospheric pressure by approximately 15 mmHg. When this valve is in an open state, evaporated fuel flows into the canister 25, and is adsorbed there. The valve 23*b* is a negative-pressure valve which opens when the tank pressure drops below the pressure on the side of the canister 25 by approximately 10 to 15 mmHg. When this valve is in an open state, the evaporated fuel adsorbed by the canister 25 returns to the fuel tank 9.

A bypass valve 24 consisting of an electromagnetic valve is provided in the second branch 20*b*. This bypass valve 24 is ordinarily in a closed state; when leakage in the discharge prevention system 31 of the present invention is detected, the opening-and-closing action of this valve is controlled by control signals from the ECU 5.

The canister 25 contains active carbon that adsorbs the evaporated fuel, and has an intake port (not shown in the figures) that communicates with the atmosphere via a passage 26*a*. A vent shut valve 26 consisting of an electromagnetic valve is provided at an intermediate point in the passage 26*a*. This vent shut valve 26 is ordinarily in an open state; when leakage of the discharge prevention system of the present invention is detected, the opening-and-closing action of this valve is controlled by control signals from the ECU 5.

The canister 25 is connected with the intake manifold 2 on the downstream side of the throttle valve 3 via the purging passage 27. A purge control valve 30 consisting of an electromagnetic valve is provided at an intermediate point in the purging passage 27, and the fuel adsorbed in the canister 25 is appropriately purged to the intake system of the engine via the purge control valve 30. The purge valve 30 continuously controls the flow rate by altering the on-off duty ratio on the basis of control signals from the ECU 5.

Next, an outline of the process of determining the presence or absence of leakage in the discharge prevention system 31 will be described. The process used to determine the presence or absence of leakage in the tank system includes a post-start open treatment and tank pressure monitoring.

Open Treatment After Start

In the open treatment after start, the bypass valve 24 is opened immediately after the engine is started, so that the discharge prevention system 31 is opened to the atmosphere. In this case, if the tank pressure shifts by a predetermined amount or greater from the value measured prior to the above-mentioned opening to the atmosphere, it is judged that the tank system is normal, with no leakage.

The open treatment after start will be described with reference to the timing chart shown in FIG. 2 and the flowchart shown in FIG. 3. When the engine is started, the ECU 5 first detects the output of the internal pressure sensor 11, and stores this detected value in the RAM 93 of the ECU 5 as the initial value P1 of the tank pressure. When a predetermined time passes for the output of the internal pressure sensor 11 to stabilize (101), a decision is made by a timer in step 102 as to whether or not the open treatment duration has elapsed. If it is still within the open treatment duration, the process moves to step 103; where, the bypass valve 24 is opened, the vent shut valve 26 is opened and the purge control valve 30 is closed based on control signals sent to the respective valves. Thus, the evaporated fuel discharge prevention system 31 is opened to the atmosphere.

Figure 2A:
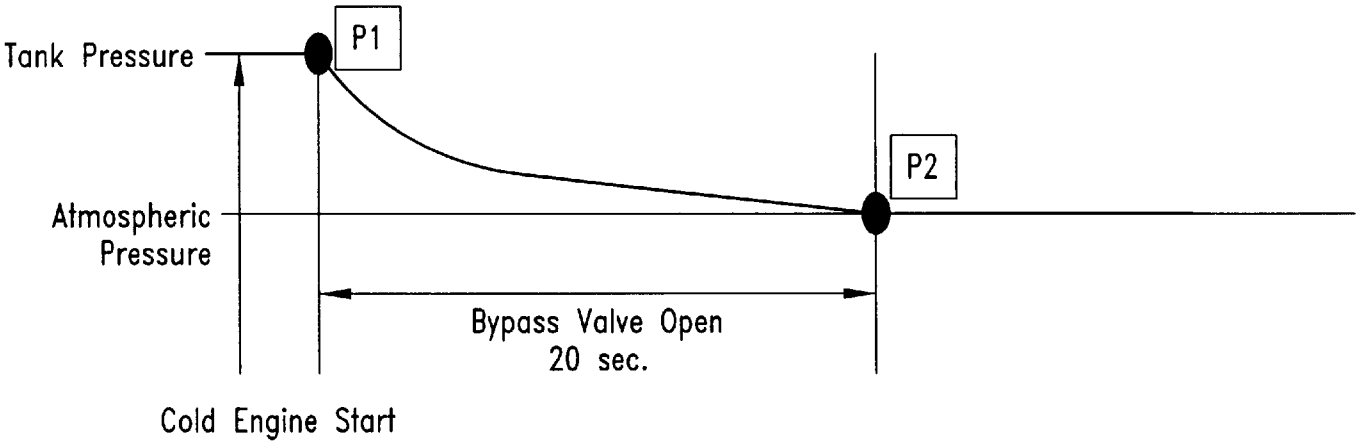
FIG. 2(A) is a graph which shows the change in the tank pressure when the tank system is opened to the atmosphere immediately after the engine is started.
Figure 2B:
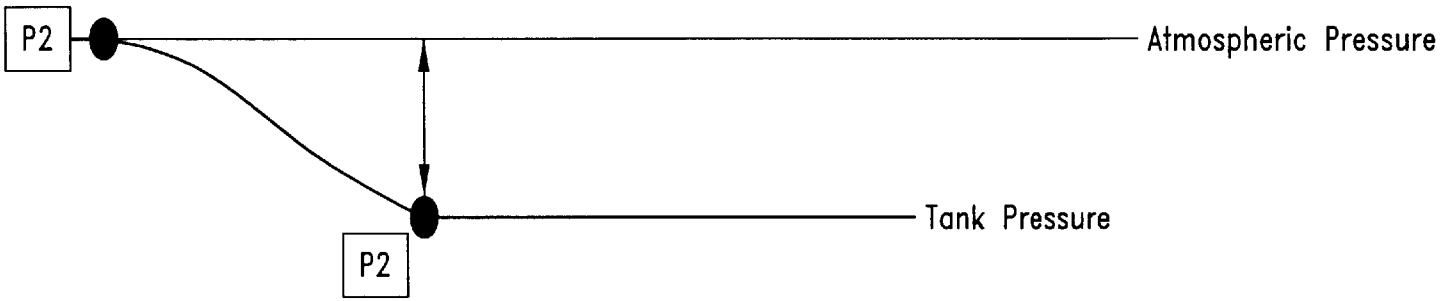
FIG. 2(B) is a graph which shows the shift in the tank pressure under ordinary conditions.
Figure 3:
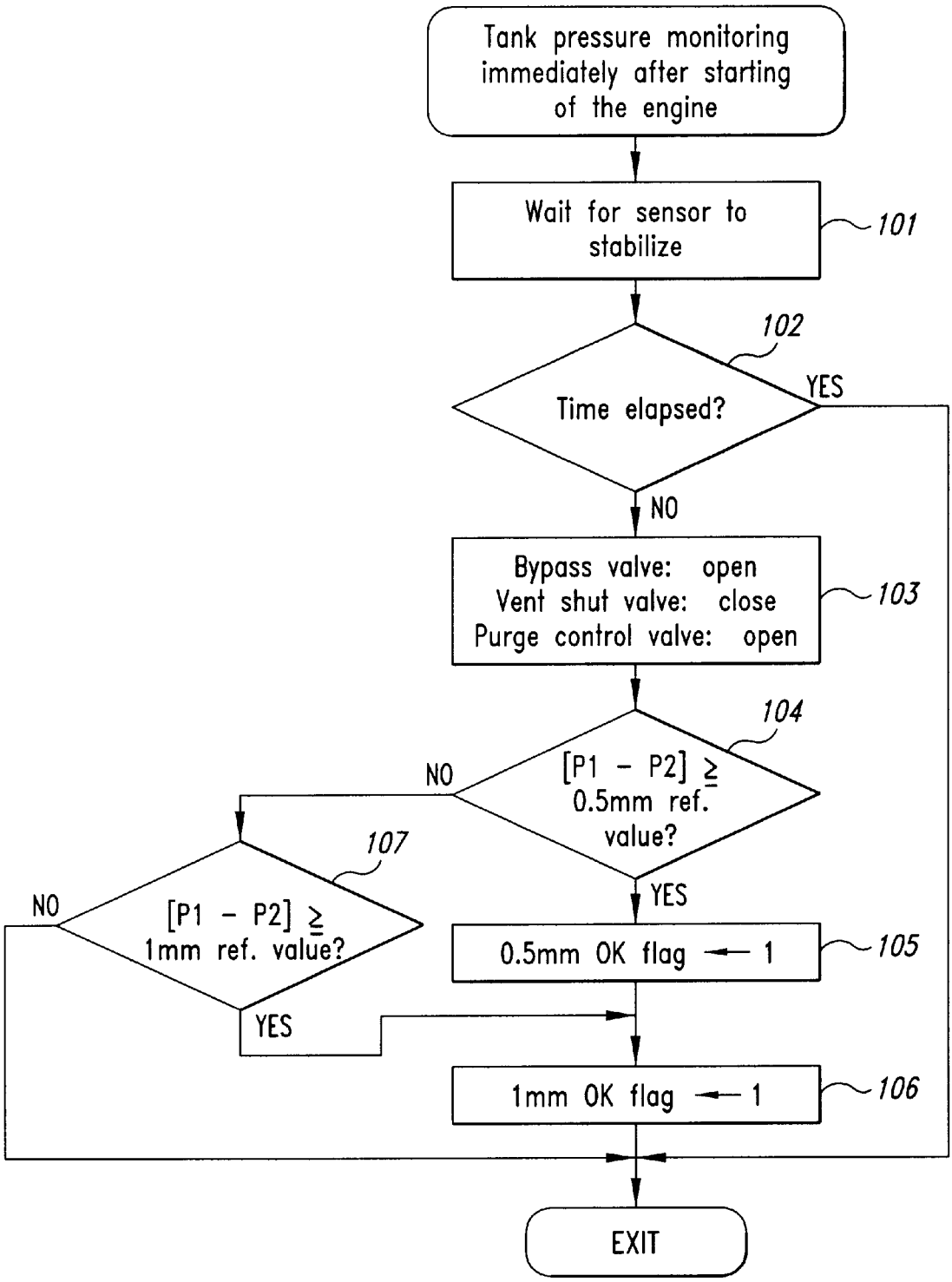
FIG. 3 is a flow chart which shows the process of monitoring the tank pressure immediately following the starting of the engine.

Next, in step 104, a judgement is made as to whether or not the absolute value of the difference between the current output value P2 of the internal pressure sensor (see FIG. 2(A)) and the initial value P1 of the tank pressure is equal to or greater than a first reference value, e.g., 4 mmHg, which is used to detect leakage caused by a hole with a diameter of 0.5 mm. Here, the initial value P1 of the tank pressure may be either a positive pressure or a negative pressure depending on the conditions of use of the vehicle up to the time in question; accordingly, the absolute value of P1−P2 is used to make the above-mentioned judgement. If the absolute value of the pressure difference is equal to or greater than the first reference value, it is determined that there is no leakage caused by a hole with diameter of 0.5 mm or greater. Accordingly, a value of 1 is set in the 0.5 mm OK flag (105), a value of 1 is set in the 1 mm OK flag, and the process ends.

In cases where the absolute value of P1−P2 is not equal to or greater than the first reference value in step 104, the process moves to step 107, and a judgement is made as to whether or not the absolute value of P1−P2 is equal to or greater than a second reference value, e.g., 2 mmHg, which is used to detect leakage caused by a hole with a diameter of 1 mm or greater. If the judgement is "yes", a value of 1 is set in the 1 mm OK flag (106), and the process ends. In this case, the resulting status is that the 0.5 mm OK flag is zero, and the 1 mm OK flag is 1. In the subsequent internal pressure monitoring process, monitoring is further performed for the 0.5 mm diameter criteria. The value P2 of the tank pressure obtained at the time of the opening treatment is stored in RAM 93 for use in the internal pressure monitoring process.

Internal Pressure Monitoring

Next, the internal pressure monitoring process will be described with reference to FIG. 4. The object of this internal pressure monitoring is to make a continuous check of the output level of the internal pressure sensor 11, and to determine that there is leakage when the output level concentrates in the vicinity of atmospheric pressure, and that there is no leakage when the output level shifts greatly toward positive pressure or negative pressure.

Figure 4A:
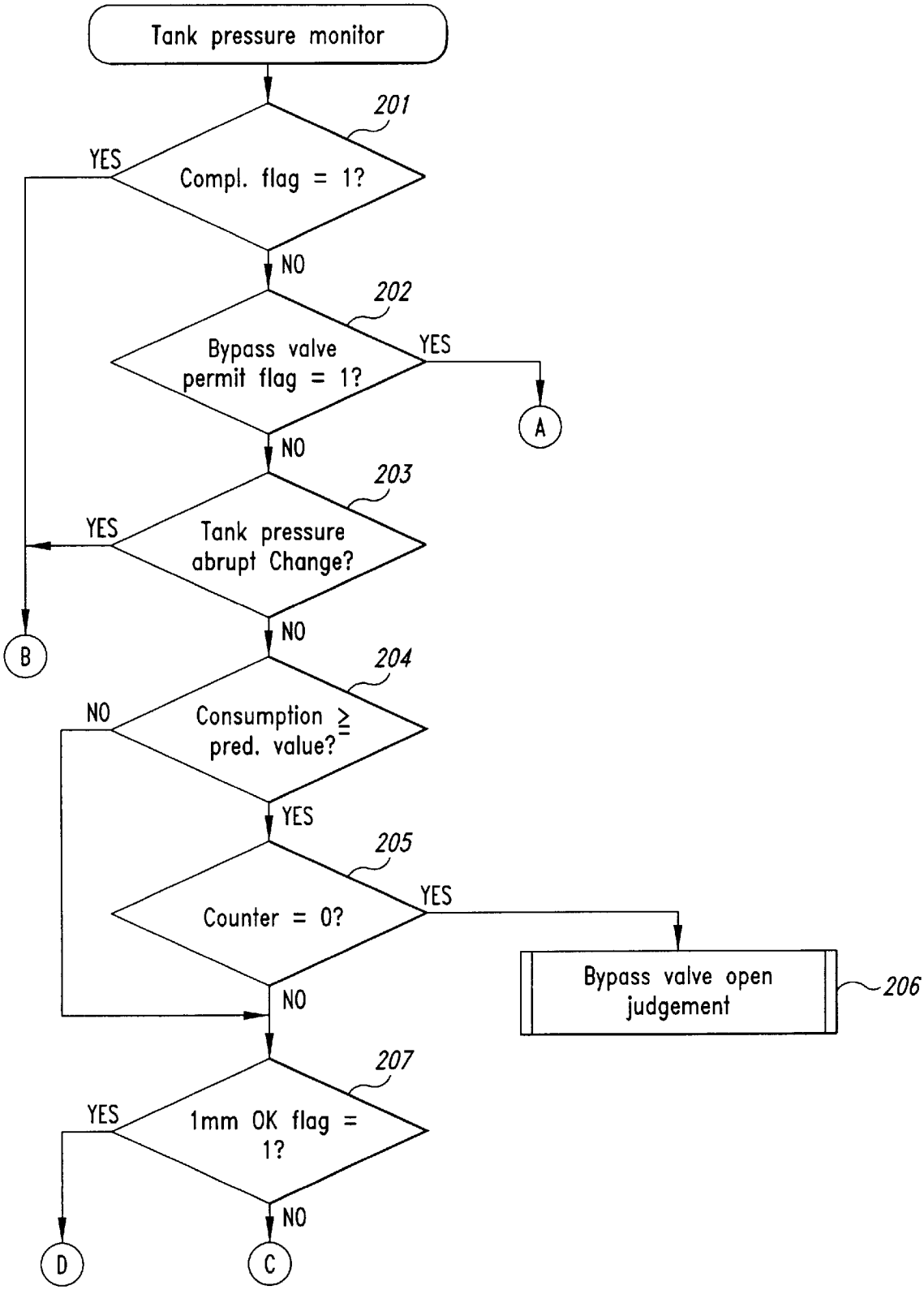
FIG. 4 is a flow chart which shows the process of monitoring the internal tank pressure.
Figure 4B:
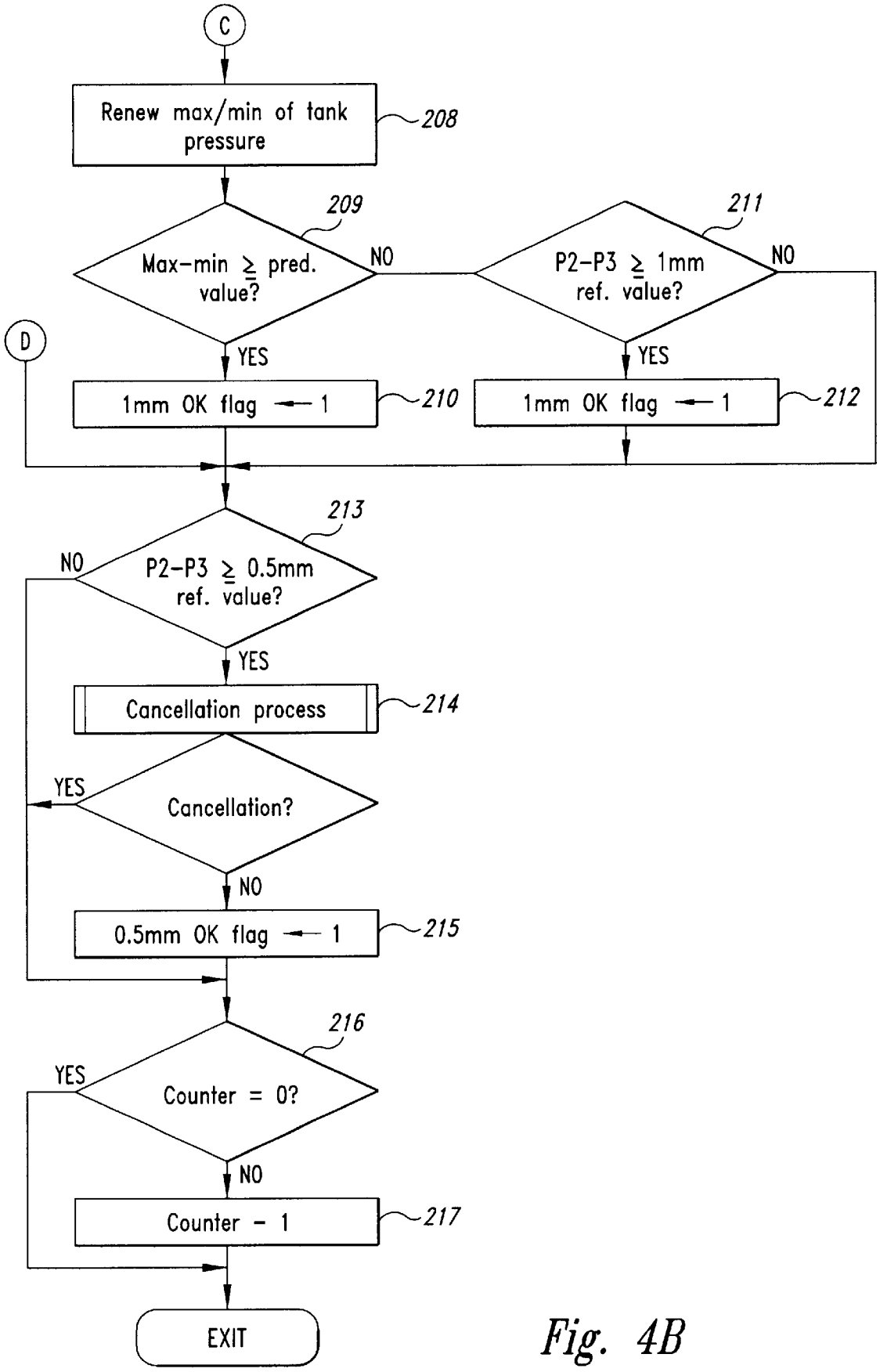
Figure 5A:
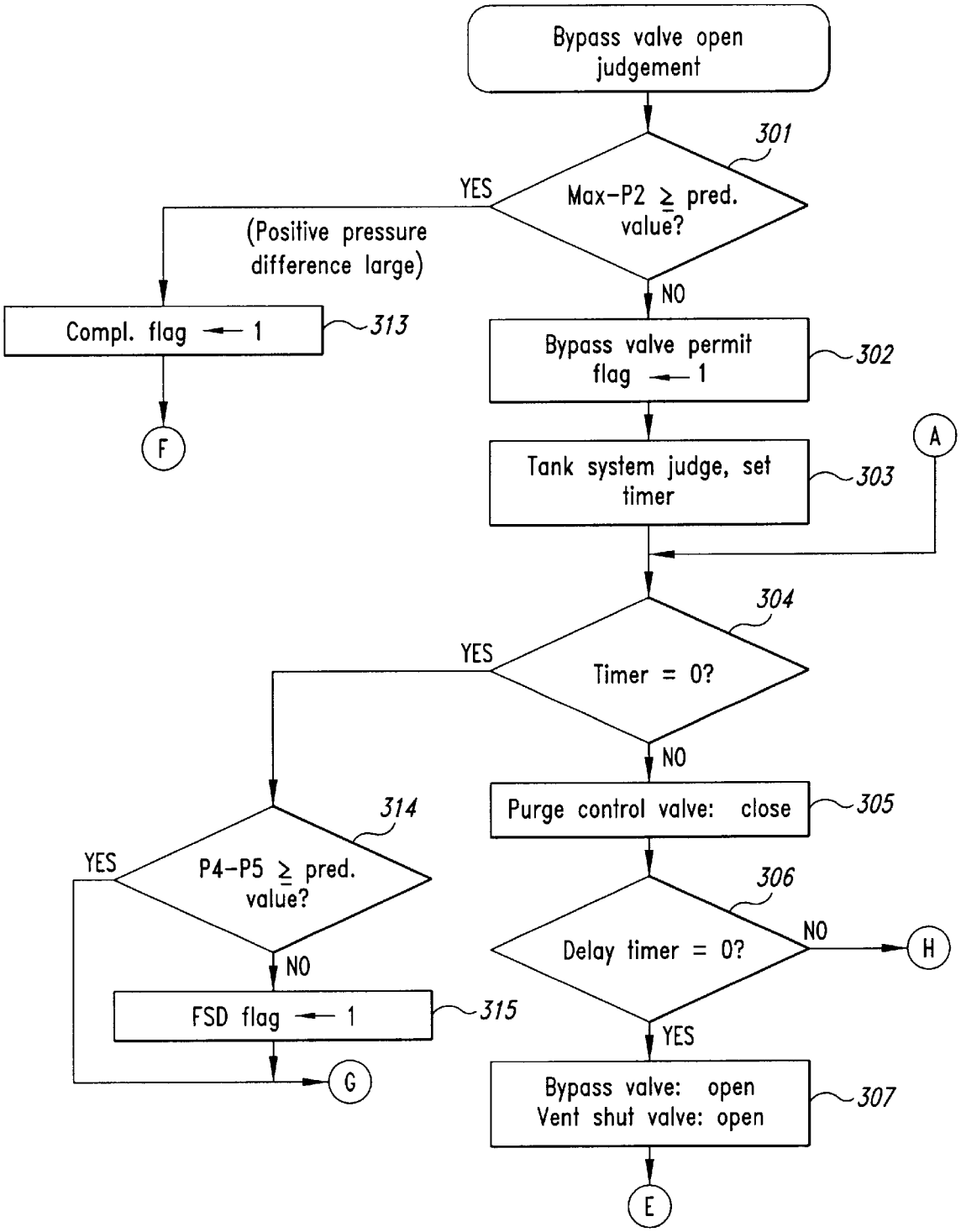
FIG. 5 is a flow chart which shows the bypass valve opening determination process.
Figure 5B:
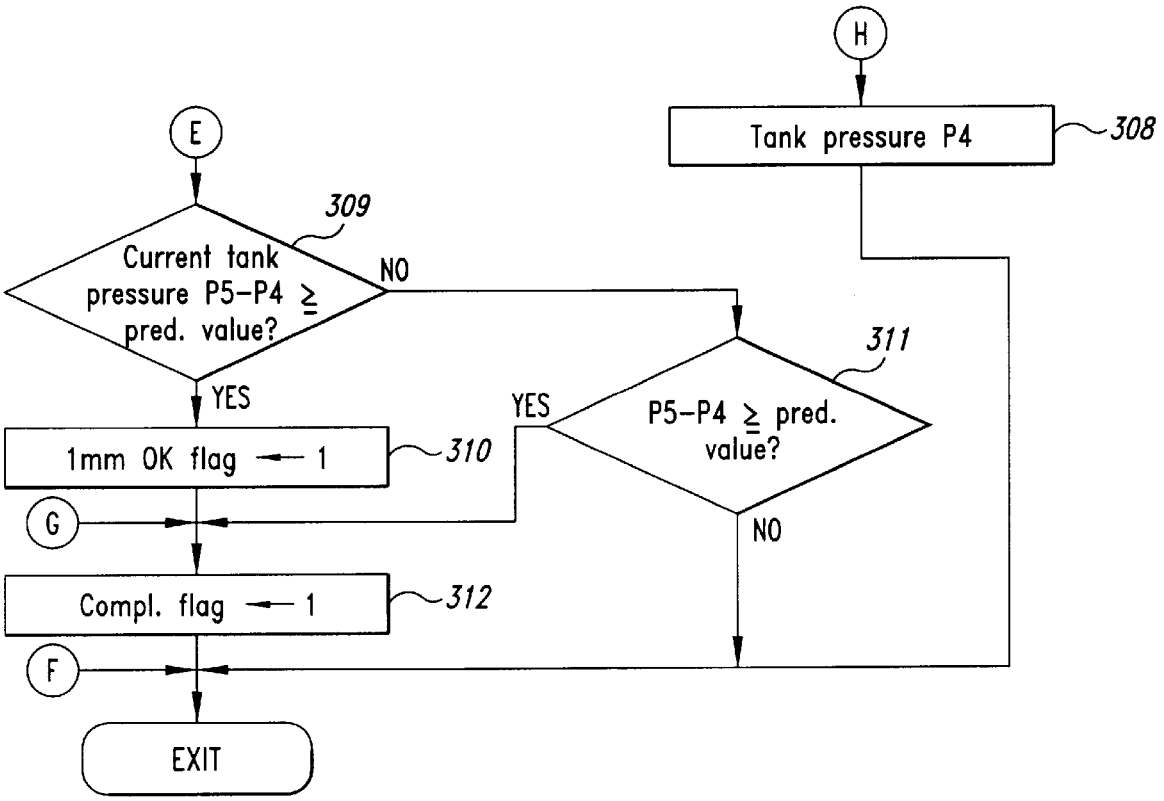

In cases where a completion flag, which is set at 1 when the series of internal pressure monitoring processes is completed, is not 1 (201), the process shown in FIG. 4 is started. In a state in which a bypass valve permission flag, which is set to 1 in a process that is to be described hereafter with reference to FIG. 5, is 1 (202), the process proceeds to FIG. 5. In cases where this flag is not 1, the process proceeds to the process from step 203 on.

A judgement is made as to whether or not there has been an abrupt change in the tank pressure by comparing the absolute value of the difference between the currently detected tank pressure and the tank pressure detected previously and stored in the RAM 93 (203). Abrupt changes in the tank pressure occur for example when the fuel level fluctuates as a result of the abrupt starting of the vehicle into motion, etc., so that the fuel contacts the tank wall surfaces and is abruptly vaporized. Such a state is not suitable for the detection of vapor leakage. Accordingly, the process is bypassed.

If it is determined that there has been no abrupt change in the tank pressure, the process moves to step 204, and a judgement is made as to whether or not the amount of fuel consumed is equal to or greater than a predetermined value. If this amount is equal to or greater than the predetermined value, and if a measurement countdown counter is at zero (205), the process proceeds to the bypass valve open judgement process (206) which will be described hereafter. This signifies a state in which a value of 1 is not set in the 1 mm OK flag even after the process starting from step 207 on in FIG. 5 has been performed a predetermined number of times. It means that the 1 mm diameter criteria could not be cleared.

The calculation of the amount of consumed fuel in step 204 uses values that are calculated in the background of the process. Specifically, the CPU 91 multiplies a predetermined coefficient to the sum of the open-valve durations of the fuel injection valves 6 during a predetermined period to obtain a fuel consumption amount, which in turn is stored in the RAM 93 and is renewed with predetermined intervals.

In cases where the amount of consumed fuel calculated in step 204 is smaller than a predetermined value, or in cases where the count value in step 205 is not zero, i.e., cases where the predicted number of repetitions of monitoring has not been reached, the process moves to step 207, and a check is made to ascertain whether or not the 1 mm OK flag is 1. This 1 mm OK flag is set when the 1 mm diameter criteria is cleared in the tank pressure monitoring performed immediately after starting as shown in FIG. 3.

If the 1 mm OK flag is not set at 1, the process proceeds to step 208. If the tank pressure currently indicated by the sensor 11 or the mean value obtained by sampling the output of the sensor a predetermined number of times (in the present specification, in accordance with the nature of the process, a simple reference to the "current tank pressure" may indicate a single measured value or the mean value of a plurality of sampled values) is greater than the maximum value of the tank pressure stored in the RAM 93 up to this point, the maximum value stored in the RAM 93 is replaced by the current tank pressure. On the other hand, if the current tank pressure is smaller than the minimum tank pressure stored in the RAM 93 up to this point, the minimum value stored in the RAM 93 is replaced by the current tank pressure.

If the difference between the maximum and minimum values thus updated, i.e., the amplitude of the shift in the tank pressure, is equal to or greater than a predetermined value (209), it is determined that there is no leakage caused by a hole with a diameter of 1 mm or greater, and the 1 mm OK flag is set to 1 (210). Here, the predetermined value used to make this judgement is a value read out from a map stored in the ROM 92 with a parameter of the engine water temperature (TW) at the time of starting the engine.

In cases where the amplitude of the shift in the tank pressure is smaller than the above-mentioned predetermined value, the process moves to step 211. If the difference between the tank pressure P2 which was measured with the system open to the atmosphere immediately after the engine was started as described with reference to FIG. 3 and stored in the RAM 93 and the current tank pressure P3 obtained from the internal pressure sensor 11 (FIG. 2(B)) is equal to or greater than the reference value used to detect leakage caused by a hole with a diameter of 1 mm or greater (e.g., 2 mmHg) (211), it is determined that the tank system has the function of maintaining a negative pressure, and that there is no leakage according to the 1 mm diameter criteria. Accordingly, the 1 mm OK flag is set to 1 (212).

In cases where the 1 mm OK flag is set in step 207, if the 1 mm OK flag is set in step 210 or step 212, or if P2−P3 is smaller than the 1 mm reference value in step 211, the process moves to step 213, and a determination is made as to whether or not P2−P3 is equal to or greater than the reference value for the 0.5 mm diameter criteria, e.g., 5 mmHg. If P2−P3 is equal to or greater than this reference value, it may be tentatively determined that the tank system has the function of maintaining a large negative pressure, and that there is no leakage according to the 0.5 mm criteria.

However, because of special factors, as will be described later in connection with OK judgement cancellation process, the tank pressure may be a negative pressure regardless of the presence or absence of leakage. Accordingly, the process goes into the cancellation process subroutine of step 214, and a judgement is made as to whether or not such special factors are present. If it is determined in this subroutine that no special factors are present (i.e., it is not decided that the judgement result of step 213 is to be cancelled), then the 0.5 mm OK flag is set (215), and if the "times" counter has not reached zero (216), the "times" counter is reduced by 1 (217) and the process is passed through. If the "times" counter has reached zero, the process is passed through "as is".

In the embodiment shown in FIG. 4, the program that executes the internal pressure monitoring process is called up at preset time intervals, e.g., every 80 milliseconds, and is repeated until the "times" counter reaches zero (205). When the "times" counter reaches zero, the process moves to the bypass valve open judgement process shown in detail in FIG. 5 (206). In the bypass valve open treatment, an internal pressure monitoring completion flag is set in step 312 or step 313. When this flag is set, this flag is detected in step 201 in the process shown in FIG. 4, and the treatment is passed through.

Accordingly, in one engine cycle (from starting of the engine to stopping), when a series of internal pressure monitoring operation has been completed, the same internal pressure monitoring is not repeated. However, the frequency with which such operations are performed is a design selection matter, and may be altered as necessary.

Bypass Valve Open Treatment

Next, the bypass valve open treatment will be described with reference to FIG. 5. In the process shown in FIG. 4, when the value of the "times" counter reaches zero (205), the process enters this treatment. Furthermore, in the process shown in FIG. 5, when it is detected that the bypass valve permission flag is set (202), the process begins from step 304 in FIG. 6. The maximum value of the tank pressure updated in step 208 in FIG. 4 is compared with the tank pressure P2 that was measured with the system open to atmospheric pressure immediately after the engine was started and stored in the RAM 93 (301). If the former is determined to exceed the latter by a predetermined value, it means that the tank system had the function of maintaining a positive pressure after starting the engine, and accordingly the internal pressure monitoring completion flag is set (313), and the process is completed.

The predetermined value used in the decision in step 301 is a value which uses as a parameter the engine water temperature (TW) at the time of starting the engine and is stored in a table in the ROM of the ECU 5. Specifically, in step 301, a predetermined value corresponding to the engine water temperature is read out from the ROM, and a comparison is made in order to ascertain whether or not (maximum value of tank pressure—P2) is equal to or greater than this predetermined value.

In cases where the result of the comparison made in step 301 is "no", the flag that gives permission to open the bypass valve is set (302), and the predetermined time consumed by the process shown in FIG. 5 is set in the tank system judgement timer (303). Since the timer value thus set is initially not zero, the process moves to step 305 via step 304, and the purge control valve 30 is closed. Step 306 is a step that waits for the closing of the purge control valve to stabilize. Initially, since the delay timer has not reached zero, the process proceeds to step 308, and the current mean value P4 of the tank pressure, which has been calculated in the background, is stored in the RAM 93.

Like the process routine shown in FIG. 4, the process routine shown in FIG. 5 is called up at predetermined time intervals, e.g., every 80 milliseconds. Accordingly, after the process has been passed through via step 308, this process is again entered, and when the delay timer 306 reaches zero, the ECU 5 sends control signals so that the bypass valve and vent shut valve are opened, thus opening the tank system to atmospheric pressure (307). In step 309, a judgement is made as to whether or not the current tank pressure P5 following the above-mentioned opening to the atmosphere has increased by a predetermined value or greater from the tank pressure P4 measured prior to the above-mentioned opening to the atmosphere. If such an increase is found to have occurred, this means that the tank system had the function of maintaining a negative pressure. Accordingly, it is determined that no leakage caused by a hole with a diameter of 1 mm or greater has occurred. Consequently, the 1 mm OK flag is set (310), the internal pressure monitoring completion flag is set, and the process is passed through (312).

In cases where it is found by the judgement made in step 309 that the shift toward atmospheric pressure from negative pressure has not reached (the above-mentioned) predetermined value, the process moves to step 311, and a judgement is made as to whether or not P4−P5 is equal to or greater than a predetermined value, i.e., as to whether or not the tank pressure P5 following opening to the atmosphere has decreased by a predetermined value or greater from the tank pressure P4 measured prior to the above-mentioned opening to the atmosphere (in other words, as to whether or not there has been a great shift toward atmospheric pressure from a positive pressure). The predetermined value used here may be a different value from the value used in step 309; typically, a value read out from a table using the water temperature (TW) at the time of starting of the engine, which is stored in the ROM of the ECU 5, is used.

If the shift in pressure is large, this means that the tank system had the function of maintaining pressure; however, since a shift from a positive pressure is not suitable for detecting the presence or absence of leakage caused by small holes, the completion flag is set without setting the OK flag (312), and the process is passed through. In cases where it is determined in step 311 that the shift in pressure is not large, the judgement process is repeated; accordingly, the process is passed through without setting the completion flag.

When the judgement process is repeated and the tank system judgement timer reaches zero (304), a judgement similar to that of step 311 is performed in step 314, and if the shift toward atmospheric pressure from a positive pressure is large, the completion flag is set, and the process is ended. If the shift is not large, an FSD flag is set (315); then, the completion flag is set, and the process is ended. The FSD flag is utilized in trouble diagnosis along with numerous other flags.

0.5 mm OK Judgement Cancellation Process

Figure 6:
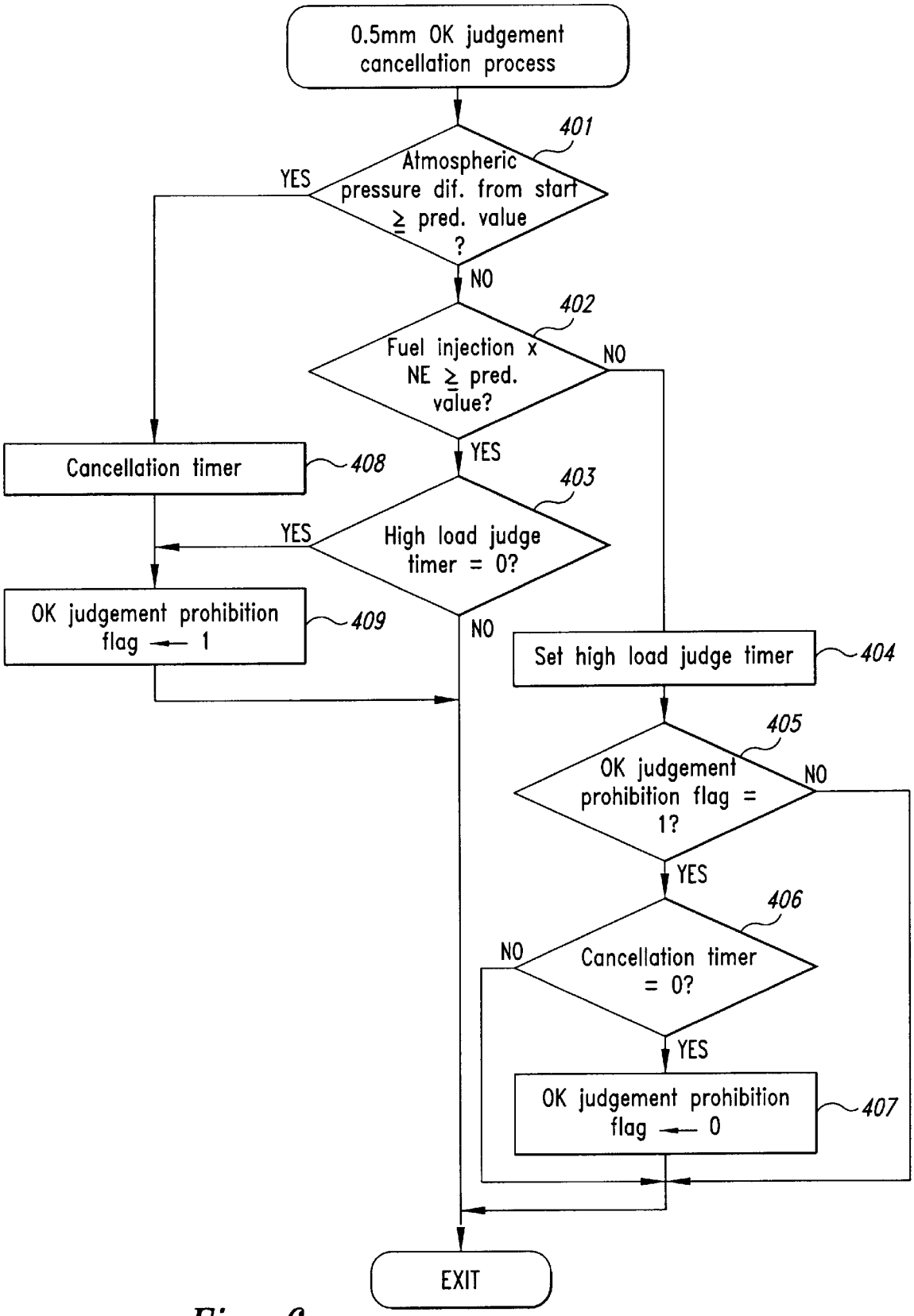
FIG. 6 is a flow chart which shows the process of canceling the determination regarding the presence or absence of leakage.

FIG. 6 is a flow chart which shows the process of the cancellation process routing in FIG. 4. The object of this process is to cancel the judgement and continue monitoring in cases where a 0.5 mm OK judgement indicating that there is no leakage according to the 0.5 mm criteria is reached in the internal pressure monitoring shown in FIG. 4, but special factors that might possibly affect this judgement are present.

Special factors that might possibly affect the 0.5 mm OK judgment include conditions in which the vehicle is operating under a high load, and conditions in which the vehicle is moving from a high place to a low place so that the atmospheric pressure varies greatly in the direction of increase.

When the vehicle is operating under a high load, e.g., when the vehicle is rapidly accelerating, etc., fuel is rapidly consumed so that the internal pressure sensor 11 temporarily senses a negative pressure. Accordingly, an OK judgement may be derived even if there is leakage caused by a very small hole with a diameter of 0.5 mm. Thus, such conditions are not suitable for making a judgement. Furthermore, as atmospheric pressure increases when the vehicle is running toward (low-lying) flatlands from higher ground, the internal pressure sensor 11 which senses the differential pressure between atmospheric pressure and the pressure inside the tank detects a pressure shift toward negative pressure. In this case as well, an OK judgement may be derived even if there is leakage caused by a very small hole with a diameter of 0.5 mm. Thus, such conditions are not suitable for making a judgement. Accordingly, in such cases, the 0.5 mm OK judgement is cancelled.

First, in FIG. 6, a judgement is made in step 401 as to whether or not the current atmospheric pressure exceeds the atmospheric pressure measured at the time that the engine was started (the value measured at the time that the engine was started is stored in the RAM 93) by a predetermined value, e.g., 5.5 mmHg, or greater. In cases where the current atmospheric pressure is greater by such a predetermined amount, the conditions are not suitable for judging the presence or absence of leakage by the 0.5 mm criteria (for the reasons described above); accordingly, the cancellation timer is set at a predetermined time, e.g., 60 seconds (408), an OK judgement prohibition flag is set (409), and the 0.5 mm OK in judgement in step 213 of FIG. 5 is cancelled. In the present embodiment, the magnitude (5.5 mmHg) of the shift of the atmospheric pressure toward the high pressure side that is used to make the above-mentioned judgement is a value that reduces the tank pressure by 3.3 mmHg.

In cases where the judgement in step 401 is "no", the process advances to step 402, and a judgement is made as to whether or not a value (indicating the load of the engine)

obtained by multiplying the engine rpm (NE) by the amount of fuel injection per unit time calculated by the ECU 5 in the background is equal to or greater than a predetermined value. If the above-mentioned calculated value is equal to or greater than this predetermined value, the process advances to step 403. Here, a value in the vicinity of the critical value having an effect on the judgement of the presence or absence of leakage according to the 0.5 mm criteria is selected on the basis of experimental data and simulated data as the predetermined value of the load used to make the above-mentioned judgement.

In step 403, if the high-load driving judgement timer set at a predetermined value, e.g., 4 seconds, in step 404 (described later) has reached zero, i.e., if high-load driving has continued for 4 seconds, the OK judgement is cancelled (409), since such conditions (for the reasons described above) are not suitable for judging the presence or absence of leakage according to the 0.5 mm criteria. If the timer has not reached zero, this process is passed through; however, since this cancellation process subroutine is called up (for example) every 80 milliseconds, a similar judgement is repeatedly performed.

If the load is not greater than the above-mentioned predetermined value in step 402, the process advances to step 404. Here, a predetermined time, e.g., 4 seconds, is set in the high-load driving judgement timer, and if the OK judgement prohibition flag is set (405), the process proceeds to step 406. In step 406, if the cancellation timer (set in step 408) has reached zero, the OK judgement prohibition flag is changed to zero, and the OK prohibition is thus cancelled. In other words, in the present embodiment, the OK judgement prohibition is cancelled after 60 seconds.

Thus, the presence or absence of leakage according to the above-mentioned 1 mm criteria and 0.5 mm criteria is detected by the completion of the (above-mentioned) series of internal pressure monitoring operations. In cases where OK judgement flags are set for both the 1 mm criteria and the 0.5 mm criteria as a result of the above-mentioned internal pressure monitoring, the tank system is considered to be normal with no leakage, and the process for detecting the presence or absence of leakage is ended. In cases where neither OK judgement flag is set, or in cases where the OK judgement flag for the 1 mm criteria is set, but the OK judgement flag for the 0.5 mm criteria is not set, the presence or absence of leakage is detected by means of reduced-pressure monitoring which sufficiently reduces the pressure of the tank system (?) (unclear wording—Tr.) and monitors the negative pressure maintenance function.

Thus it has been shown that according to one embodiment of the invention, first and second reference values are set in correspondence with a first leak diameter and a second leak diameter constituting objects of detection, and the presence or absence of leakage is determined by means of these respective reference values. Accordingly, correspondences related to the respective detections can be established.

According to the second embodiment, a judgement can be made for two judgement criteria immediately following the starting of the engine as to whether or not the fuel tank system had the function of maintaining pressure while the internal combustion engine was stopped, i.e., as to whether or not any hole were formed in the fuel tank system.

The invention is described with respect to specific embodiments. Additions, subtractions and other modifications will be apparent to those skilled in the art and are within the scope of the invention.

What is claimed is:

1. An evaporated fuel treatment system for an internal combustion engine comprising:

a fuel tank;

a canister having an interior and an opening that opens the interior to the atmosphere, and which adsorbs evaporated fuel generated inside the fuel tank;

a charging passage that communicates with said fuel tank and with said canister;

a pressure adjustment valve provided in said charging passage;

an internal pressure sensor provided upstream from said pressure adjustment valve to detect and output the vapor pressure inside said fuel tank; and a controller configured to detect leakage on the upstream side of said pressure adjustment valve according to the output of said sensor, said controller having at least a first stored reference value for a first leak diameter to be detected and a second stored reference value for a second leak diameter to be detected, and configured to determine the absence of leakage by comparing the output of said internal pressure sensor with said first and second reference values.

2. An evaporated fuel treatment system for an internal combustion engine comprising:

a fuel tank;

a canister having an interior and an opening that opens the interior to the atmosphere, and which adsorbs evaporated fuel generated inside the fuel tank;

a charging passage that communicates with said fuel tank and with said canister;

a pressure adjustment valve provided in said charging passage;

a bypass passage that bypasses said pressure adjustment valve in said charging passage;

a bypass valve configured to open and close said bypass passage;

an internal pressure sensor provided upstream from said pressure adjustment valve to detect and output the evaporated fuel vapor pressure inside said fuel tank; and a controller configured to detect leakage in the fuel tank system on the upstream side of said pressure adjustment valve according to the output of said sensor when said bypass valve is opened from a closed state, said controller having at least a first stored reference value for a first leak diameter to be detected and a second stored reference value for a second leak diameter to be detected, and configured to determine the absence of leakage by comparing with said first and second reference values the difference between the output value of said internal pressure sensor when said bypass valve is closed and the output value of said internal pressure sensor when said bypass valve is opened so that said fuel tank system is opened to the atmosphere.

3. A method for detecting vapor leaks in a fuel tank, the fuel tank associated with an engine and communicating with a vapor recovery device through a first conduit, the method comprising:

determining the pressure of vapor in the fuel tank when the fuel tank is not open to the atmosphere and generating a first vapor pressure value;

determining the pressure of vapor in the fuel tank when the fuel tank is open to the atmosphere and generating a second vapor pressure value; and comparing with at least one reference value the differential between the first and second vapor pressure values;

wherein the at least one reference value comprises a first reference value corresponding to a first leak diameter to be determined and a second reference value corresponding to a second leak diameter to be determined, and further wherein the comparing comprises generating first and second comparison values, respectively.

4. The method of claim 3, further comprising generating an error signal when either of the first and second comparison values meets a predetermined threshold value.

5. The method of claim 3, further comprising monitoring engine loads and delaying the determining the pressure of vapor in the fuel tank when the engine load is higher than a predetermined load value.

6. The method of claim 3, further comprising monitoring the change in atmospheric pressure per unit time and delaying the determining the pressure of vapor in the tank when the change in atmospheric pressure per unit time meets a predetermined change value.

* * * * *